US008851954B2

(12) United States Patent
McCafferty et al.

(10) Patent No.: US 8,851,954 B2
(45) Date of Patent: Oct. 7, 2014

(54) YO-YO WITH AN ACCESSORY ATTACHMENT SYSTEM AND A MOVABLE STRING BEAD

(76) Inventors: Jim McCafferty, San Clemente, CA (US); Steve Delacy, Santa Ana, CA (US); Greg Leong, Irvine, CA (US)

( * ) Notice: Subject to any disclaimer, the term of this patent is extended or adjusted under 35 U.S.C. 154(b) by 128 days.

(21) Appl. No.: 13/571,327

(22) Filed: Aug. 9, 2012

(65) Prior Publication Data

US 2014/0045404 A1 Feb. 13, 2014

(51) Int. Cl.
*A63H 1/30* (2006.01)

(52) U.S. Cl.
CPC ..... *A63H 1/30* (2013.01)
USPC ..... 446/250

(58) Field of Classification Search
CPC ..... A63H 1/30
USPC ..... 446/250
See application file for complete search history.

(56) References Cited

U.S. PATENT DOCUMENTS

| | | | | |
|---|---|---|---|---|
| 1,793,151 | A | 2/1931 | Asbury | |
| 2,739,415 | A | 3/1956 | Roberton | |
| 2,794,294 | A | 6/1957 | Frangos | |
| 3,081,578 | A | 3/1963 | Mosher | |
| 3,287,846 | A | 11/1966 | Frangos | |
| 3,805,443 | A * | 4/1974 | Duncan, Jr. | 446/250 |
| 3,936,974 | A | 2/1976 | House | |
| 4,207,701 | A * | 6/1980 | Kuhn | 446/250 |
| 4,332,102 | A | 6/1982 | Caffrey | |
| 5,813,897 | A | 9/1998 | Van Dan Elzen et al. | |
| 5,813,898 | A | 9/1998 | Van Dan Elzen et al. | |
| 5,951,361 | A | 9/1999 | Van Dan Elzen et al. | |
| 5,984,759 | A | 11/1999 | O'Sullivan | |
| 6,004,183 | A | 12/1999 | Dixon | |
| 6,066,024 | A | 5/2000 | McAvoy, Jr. | |
| 6,080,035 | A | 6/2000 | Pekarsky | |
| 6,146,233 | A | 11/2000 | Hedeen | |
| 6,155,903 | A | 12/2000 | Van Dan Elzen et al. | |
| 6,162,109 | A | 12/2000 | Baier | |
| 6,206,749 | B1 | 3/2001 | Bell | |
| 6,234,861 | B1 | 5/2001 | Ichii et al. | |
| 6,565,408 | B1 | 5/2003 | Marcantonio | |
| 7,059,932 | B1 | 6/2006 | Tobias | |

(Continued)

FOREIGN PATENT DOCUMENTS

| | | |
|---|---|---|
| CN | 1243021 | 2/2000 |
| EP | 0986426 Al | 3/2000 |

(Continued)

OTHER PUBLICATIONS

Ho Keun Song, Patent Cooperation Treaty International Search Report & Written Opinion of the International Searching Authority, Oct. 24, 2013, Korean Intellectual Property Office, Republic of Korea.

*Primary Examiner* — John Ricci
(74) *Attorney, Agent, or Firm* — Marc E. Hankin; Kevin Schraven; Jimmy Sauz

(57) ABSTRACT

This invention is a yo-yo with a non-spinning and externally accessible, independently rotating axle that functions as an accessory attachment system to which stunt attachments can be attached. Also described are a variety of possible trick and stunt accessories. Further disclosed is a bead, which surrounds the yo-yo string, such that recoil of the yo-yo is controlled through engagement with the internal wall of the rotating disks.

19 Claims, 12 Drawing Sheets

(56) References Cited

U.S. PATENT DOCUMENTS

| | | | |
|---|---|---|---|
| 7,125,310 | B1 | 10/2006 | Van Dan Elzen |
| 7,281,965 | B2 | 10/2007 | Torres |
| 7,740,517 | B2 | 6/2010 | Hochstrasser |
| 7,874,890 | B2 | 1/2011 | Van Dan Elzen |
| 8,075,365 | B2 | 12/2011 | Schonert |
| 2001/0001087 | A1 | 5/2001 | Ichii et al. |
| 2004/0198151 | A1 | 10/2004 | Bell |
| 2005/0233674 | A1 | 10/2005 | Torres |
| 2006/0094329 | A1 | 5/2006 | Van Dan Elzen |
| 2007/0032164 | A1 | 2/2007 | Chow |
| 2010/0022159 | A1 | 1/2010 | Schonert |

FOREIGN PATENT DOCUMENTS

| | | | |
|---|---|---|---|
| FR | 2781386 | A1 | 1/2000 |
| FR | 2781386 | B1 | 12/2001 |
| JP | 2000-037564 | A | 2/2000 |
| JP | 2000-037565 | A | 2/2000 |
| JP | 2000-093660 | A | 4/2000 |
| JP | 2000-504264 | A | 4/2000 |
| JP | 3236822 | B2 | 12/2001 |
| WO | WO 98-50125 Al | | 11/1998 |
| WO | WO 2005-105247 | A2 | 11/2005 |
| WO | WO 2005-105247 | A3 | 12/2006 |

* cited by examiner

YO-YO WITH AN ACCESSORY ATTACHMENT SYSTEM AND A MOVABLE STRING BEAD

FIELD OF INVENTION

This invention generally relates to yo-yos. Moreover, it pertains specifically to a yo-yo with a non-spinning and externally accessible, independently rotating axle that provides at least two accessory attachment points to which stunt attachments may be attached. Additionally the yo-yo preferably has a movable bead that is slideably attached to the yo-yo string such that the strings engagement with the internal walls of the yo-yo can be controlled, altered or changed.

BACKGROUND

Since at least as early as 500 B.C., children and professionals have played with yo-yos. Some scholars argue that the most basic yo-yo was invented in ancient Greece. Others contend the yo-yo was first invented in ancient China. Regardless of its origin, advances in technology have improved many of the features of this ageless invention. Yo-yos have varied in popularity throughout the last couple of decades, but remain a staple and popular toy for children and adults alike.

The basic yo-yo features two disk shaped substantially identical halves separated slightly in space by an axle connector known in the art as center bushing. Yo-yos have historically been made of wood, but modernly yo-yos are made of metal, plastic, or wood. Further, the very simple structure of the yo-yo has been slowly improved upon to yield the modern yo-yo.

The modern yo-yo era is widely attributed to Donald Duncan who popularized the yo-yo in America in the mid 1900s. Mr. Duncan originally had a trademark in the name "Yo-yo." Because of the words' popularity, the Court of Appeals for the $7^{th}$ Circuit ruled that the name was so ubiquitous, it was part of language and the word lost its trademark status. The Duncan Toys Company remains a major player in the art and manufacture of yo-yos.

The basic yo-yo string has a loop that surrounds the rigid axle and a loop on the opposite end that is tied to the user's finger. The string is wound around the axle and the user throws the yo-yo toward the ground and following a quick jerking motion, and on a child's happiest day, the yo-yo recoils. The string of the yo-yo itself has been subject to very few recent improvements.

Regarding references that disclose a non-spinning and externally accessible axle of a yo-yo, U.S. Pat. No. 3,287,846, issued to Frangos ("Frangos); U.S. Pat. No. 3,081,578, issued to Mosher ("Mosher"); and U.S. Pat. No. 7,874,890, issued to Van Dan Elzen ("Elzen I"); and U.S. Published Patent Application No. 2006/0094329, filed by Van Dan Elzen ("Elzen II") each disclose such a limitation. Frangos discloses a gyroscopic top that employs a pair of rotor sectors mounted on opposite sides of a spacer all centered on an axle. Frangos' motion is initiated by a string wrapped around the center separator being pulled quickly to instantiate rotation. Mosher, Elzen I, and Elzen II each disclose a yo-yo with an externally accessible axle attached to a non-spinning portion of the yo-yo that may be engaged by the user without stopping the spinning. In the art, an externally accessible "side cap" that permits a user to engage the side cap without disrupting the rotation of the yo-yo is known, most commonly, as a "Hubstack." Each of these references disclose a yo-yo, or a yo-yo like device, that uses an independent axle to allow for a user to engage the yo-yo without halting its spinning. Importantly, however, each of these references fails to disclose a yo-yo with an accessory attachment system achieved by an independent axle, that allows for user engagement of the attached accessories, where the user engagement piece may be exchanged for any one of a select number of specific use pieces to perform a wide array of yo-yo stunts and tricks.

Regarding the removable yo-yo string and the slide-able bead, U.S. Pat. No. 6,146,233, issued to Hedeen; U.S. Pat. No. 7,059,932, issued to Tobias; and U.S. Pat. No. 2,739,415, issued to Roberton; each disclose a similar device. Each of these references is directed toward a top and string combination, not a yo-yo, wherein each has a string end feature that connects the spinning part of the toy to the string to aid in giving rotational force to the top before disengaging from the toy. While these devices serve a similar string-engagement function, these references fail to disclose a device that would function to permit a yo-yo to be either looped or not looped and that functions to make easier the recoil function of the yo-yo. Further, they fail to disclose a device that permits a yo-yo user to control with precision the recoil of her yo-yo.

Thus, there remains a long-felt need in the art for a yo-yo with an accessory attachment system and for a yo-yo string with a movable bead to improve control of recoil of the yo-yo.

SUMMARY OF THE INVENTION

To minimize the limitations in the prior art, and to minimize other limitations that will become apparent upon reading and understanding the present specification, the present invention discloses a high performance yo-yo with a user-engageable axle, that does not affect the spinning of the primary yo-yo body. The engageable axle functions as a robust accessory attachment system. Additionally, the present invention discloses a yo-yo string with an adjustable bead that may be positioned in differing proximities to a yo-yo axle, providing user control of the recoil action by engaging more or less readily, the yo-yos spinning disks.

One embodiment of this invention includes a yo-yo with a non-spinning and externally accessible axle that functions as an accessory attachment system to which a user may attach a plurality of stunt pieces. The stunt pieces do not spin in a fixed rotational path relative to the main body of the yo-yo. While Hubstacks (discussed above) permit a user to engage the yo-yo, functional accessories permit unique and an abundance of as-of-yet undeveloped tricks to go far beyond merely engaging the yo-yo. This opens the range of yo-yo tricks into a new era of creativity for the user. By way of example, one embodiment of a non-spinning stunt attachment may be a hemispherical shape and largely filled with rubber, such that it looks like a "half ball." This half ball accessory permits a user to, perhaps, bounce the yo-yo off of walls, tables, other yo-yos, or any other surface which the user chooses and tries.

Another embodiment and aspect of this invention is a modification, in the form of an attachable bead, to the traditional yo-yo string. The present invention includes a bead, which surrounds a portion of the yo-yo string. The bead is preferably a small tacky tube with a small convex bulge substantially at its center. This bulge engages the internal sides of the rotating disks and permits recoil of the yo-yo back up the string to the user end. The bead is preferably made of rubber or plastic, but may be made from any type of material. The bead preferably stays in place, but when engaged by the user is slidable along the length of the string. This allows the user to adjust the position of the bead along the string. For example, the user may move the bead closer to the center axle of the yo-yo, which makes engaging the inside of the rotating disks more likely and hastening the user's ability to recoil the yo-yo. This ability to control the proximity of the bead to the center axle permits the user to increase or decrease the yo-yo's responsiveness, which is an important concern of yo-yo enthusiasts.

Another embodiment of the invention involves both the use of an independently spinning, externally accessible axle to which a user may attach a plurality of stunt pieces as well as a string comprising a bead. The accessory attachment systems rotation is independent from the rotating disks. This embodiment permits the user to have all of the functionality gained by the stunt pieces as well as the improved user control imparted by the bead.

An object of the present invention is to provide a fun, high-end yo-yo with unique functionality that will overcome the deficiencies of the prior art.

Another object of the present invention is to provide a variety of attachments for the user-engagement axle of the yo-yo so that yo-yo enthusiasts might find new and unique ways to interact with their yo-yos.

Yet another object of the present invention is to provide a device that aids in the recoiling of the yo-yo to the hand, as many find this step the most difficult part of interacting with a yo-yo. The adjustability of the present invention makes it so that a user may choose just how challenging she wants it to be to cause the recoiling action.

Other features and advantages are inherent in the yo-yo claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance "rotating disk" refers to the two primary disks of a yo-yo structure. "Bead" is used to refer to a small tacky tube, which surrounds a portion of the yo-yo string. The bead is preferably slideably adjustable.

Figure 1:
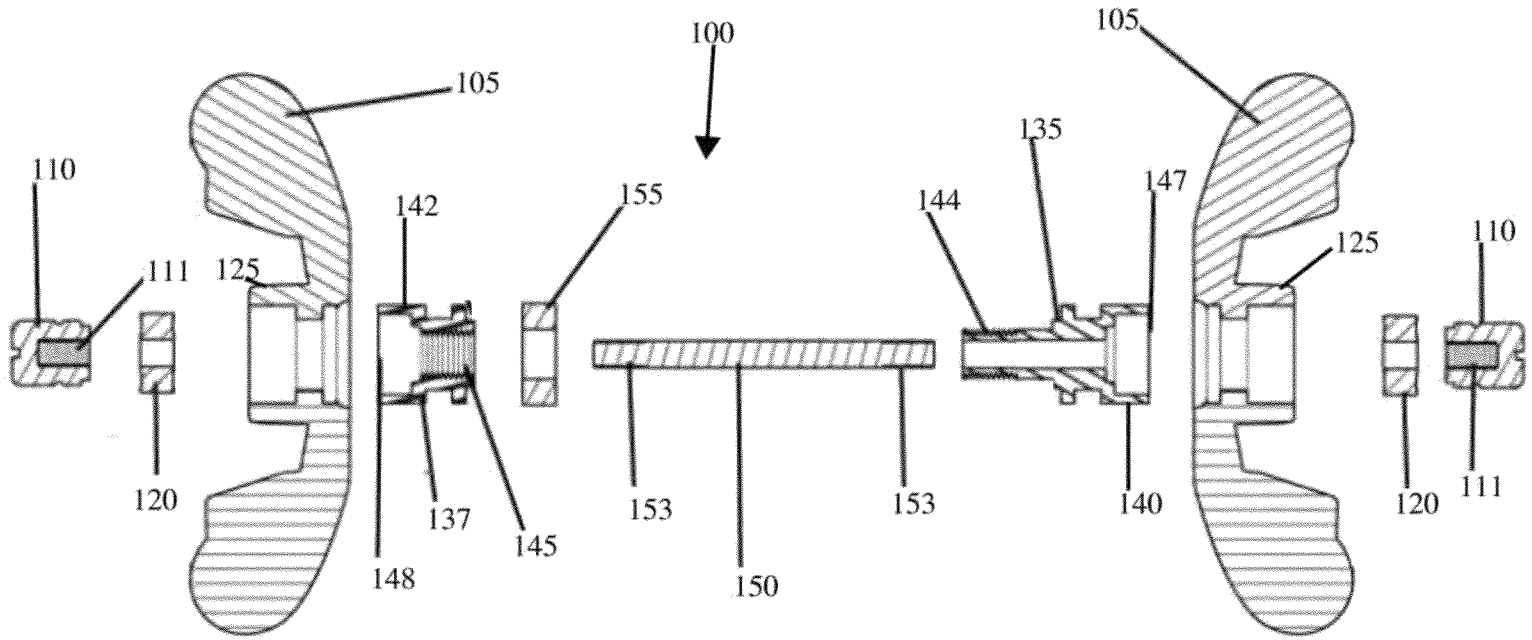
FIG. 1 is an illustration of an exploded sectional view of one embodiment of the yo-yo.

FIG. 1 is an illustration of an exploded sectional view of one embodiment of the yo-yo 100. The following description of parts of the disclosed accessory attachment system may be exchanged for others with similar function, as would be apparent to one skilled in the art. The following description is but one embodiment of the present invention. As shown in FIG. 1, the yo-yo 100 is preferably comprised of: end caps 110, which include interior threads 111; side bearings 120; rotating disks 105; which include side portions 125; bearing housings 135 and 137, which include, tubes 140 and 142, exterior threads 144 and interior threads 145, and openings 147 and 148; axle 150, which includes threaded ends 153; and center bearing 155.

As shown in FIG. 1, end caps 110 fits into side bearing 120. The end caps are preferably female treaded with interior threads 111. End caps 110 and side bearings 120 are preferably fitted into openings 147 and 148 in tubes 140 and 142 of bearing housings 135 and 137. Bearing housings 135 and 137 are preferably matingly enclosed within side portions 125. When the yo-yo 100 is assembled, the axle 150 is preferably attached, via interior threads 111 and threaded ends 153, to end caps 110. Surrounding axle 150 are center bearing 155, bearing housing 135, and side bearings 120. Side bearings 120 engage with axle 150, but rotational movement between these parts is essentially uninhibited. As such, when the yo-yo is in operation, the rotating disks revolve freely around axle 150. This allows end caps 110, which are attached to axle 150 to be grasped without interfering in the rotational movement of the rotating disks 105. As shown in FIG. 1, the center bushing 155 fits around bearing housing 135 and is held in place by bearing housing 137.

In the preferred embodiment, the end caps 110, side bearings 120, bearing housings 135 and 137, axle 150, and center bearing 155 are made from composed of high quality metal. In alternative embodiments, these parts and the rotating disks 105 may be made of plastic, wood, or other natural, man-made, or synthetic, without deviating from the scope of the invention. Rotating disks 105 are preferentially made of high quality, impact resistant plastic. When the yo-yo 100 is assembled, it is preferably balanced in weight. Although FIG. 1 shows the yo-yo 100 having certain parts, it should be understood that the yo-yo 100 may be made from any number of parts. For example, the end caps 105 and the axle 150 may be a single piece and the bearing housings may be part of the enclosing rotating disk.

Figure 2:
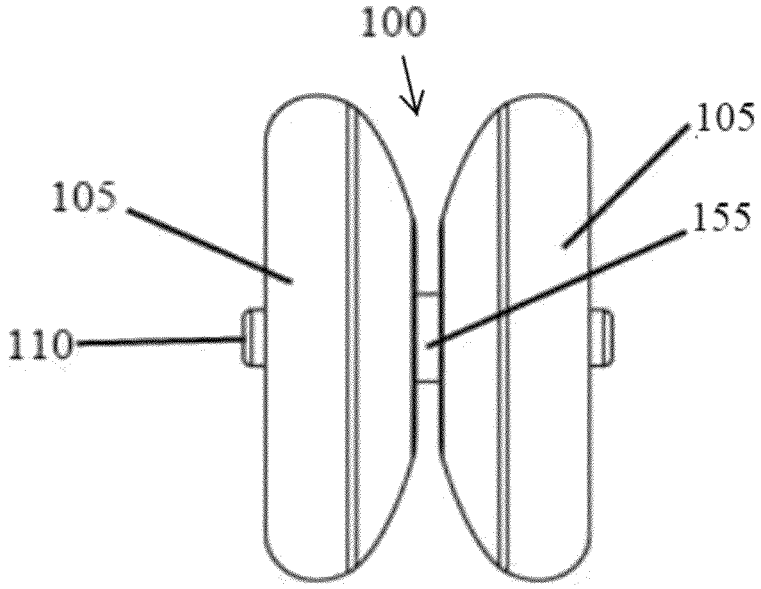
FIG. 2 is an illustration of a front view of one embodiment of the yo-yo.

FIG. 2 is an illustration of a front view of one embodiment of the yo-yo. FIG. 2 shows the preferred assembled view of the yo-yo 100. In this embodiment, substantially circular/cylindrical rotating disks 105 are connected to, indirectly or directly, center bushing 155. The center bushing 155 is preferably a cylindrical bearing that allows the outer portion to rotate independently from the inner portion that surrounds bearing housing 135 and rotating disks 105. As shown in FIG. 2, the end caps 110 preferably extend beyond the rotating disks 105 to permit easy engagement of the end caps 110 and connection of various types of accessories.

Figure 3:
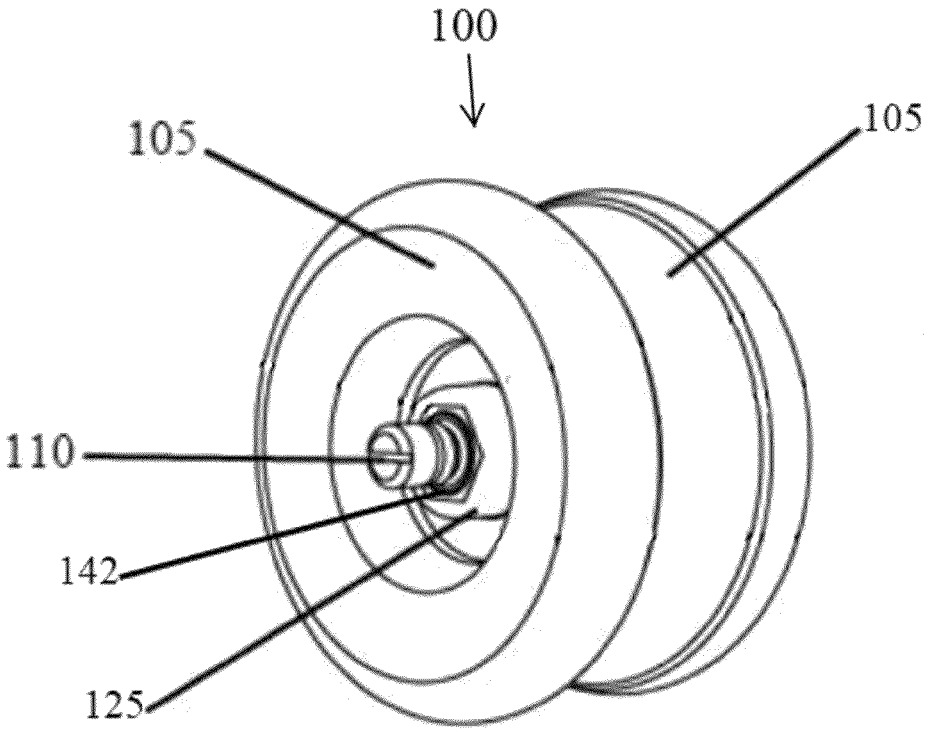
FIG. 3 is an illustration of a perspective view of one embodiment of the yo-yo.

FIG. 3 is an illustration of a perspective view of one embodiment of the yo-yo. As shown in FIG. 3, the yo-yo 100 preferably includes rotating disks 105, end cap 110, side portions 125; and tube 142. As shown in FIG. 3, end cap 110 is preferably cylindrical in shape and has a notch to allow removal through a screw driver.

Figure 4:
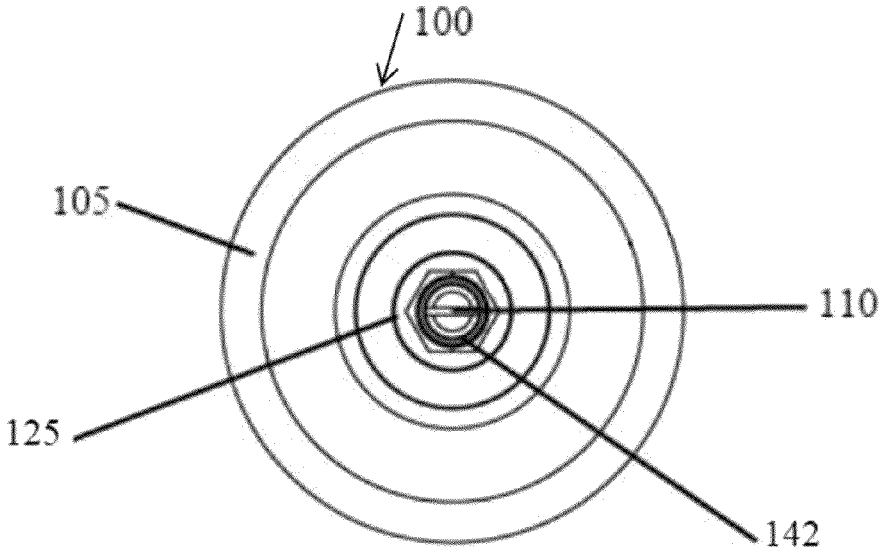
FIG. 4 is an illustration of a side view of one embodiment of the yo-yo.

FIG. 4 is an illustration of a side view of one embodiment of the yo-yo. As shown in FIG. 4, the yo-yo 100 preferably includes rotating disk 105, end cap 110, side portions 125; and tube 142.

Figure 5:
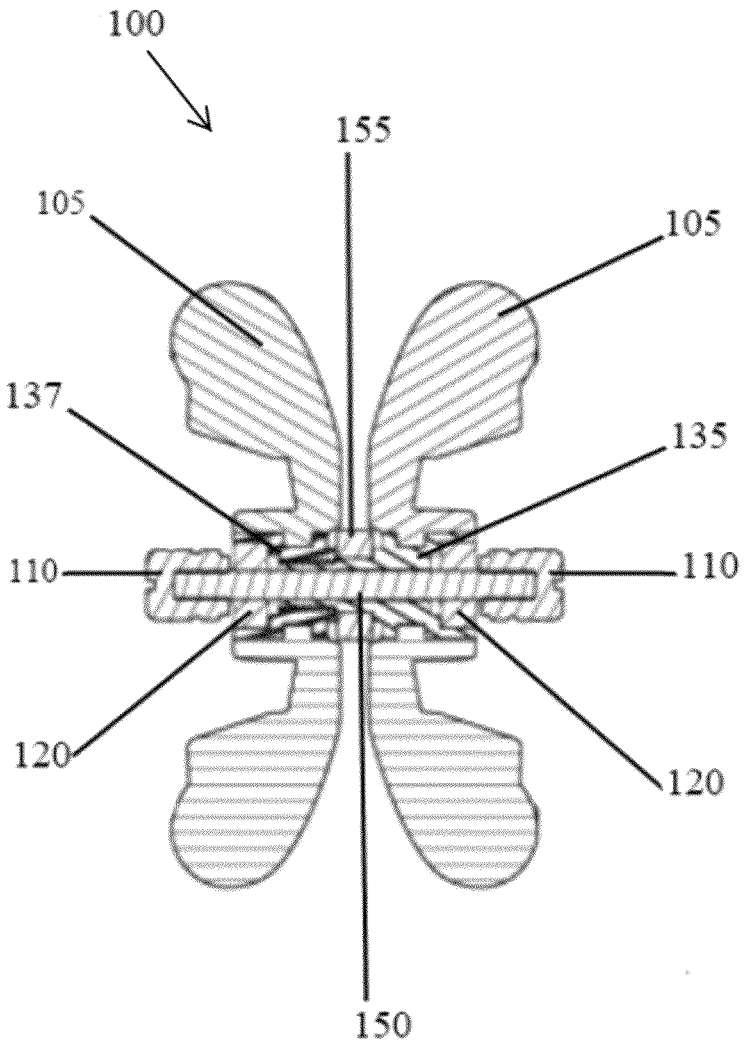
FIG. 5 is an illustration of a cross-sectional view of one embodiment of the yo-yo.

FIG. 5 is an illustration of a cross-sectional view of one embodiment of the yo-yo. FIG. 5 shows yo-yo 100 as assembled. As shown in FIG. 5, end caps 110 fits into side bearing 120. Bearing housings 135 and 137 are preferably matingly enclosed within side portions 125. The axle 150 is preferably attached to end caps 110. Surrounding axle 150 are center bearing 155, bearing housing 135, and side bearings 120. Side bearings 120 engage with axle 150, but rotational movement between these parts is essentially uninhibited. As such, when the yo-yo is in operation, the rotating disks revolve freely around axle 150. This allows end caps 110, which are attached to axle 150, to be grasped without interfering in the rotational movement or spinning of the rotating disks 105. As shown in FIG. 5, the center bushing 155 fits around bearing housing 135 and is held in place by bearing housing 137.

Figure 6:
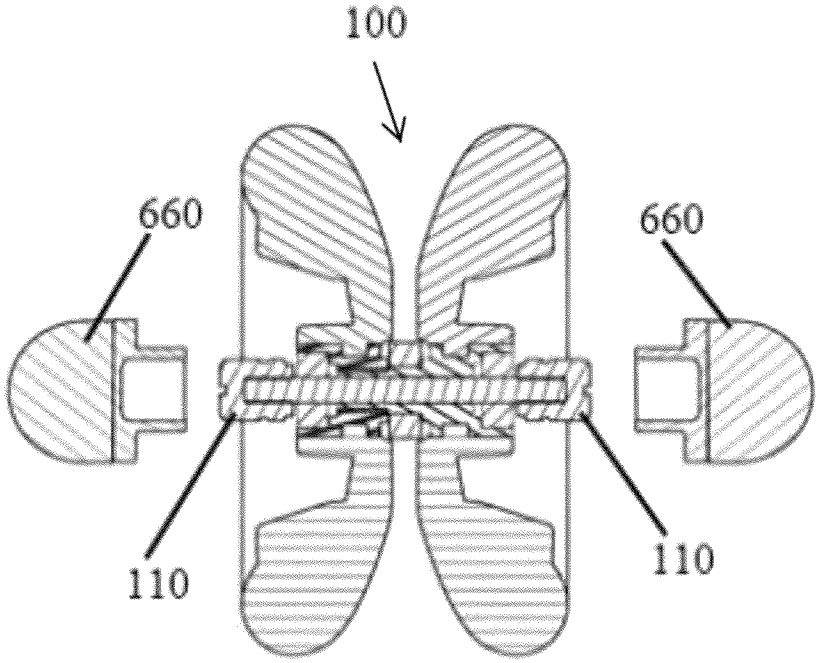
FIG. 6 is an illustration of a cross-sectional view of one embodiment of the yo-yo showing how the accessories fit onto the yo-yo.

FIG. 6 is an illustration of a cross-sectional view of one embodiment of the yo-yo showing how the accessories fit onto the yo-yo. As shown in FIG. 6, the stunt accessories 660 may be lined up outside end caps 110 of yo-yo 100, and then attached as shown in FIG. 7.

Figure 7:
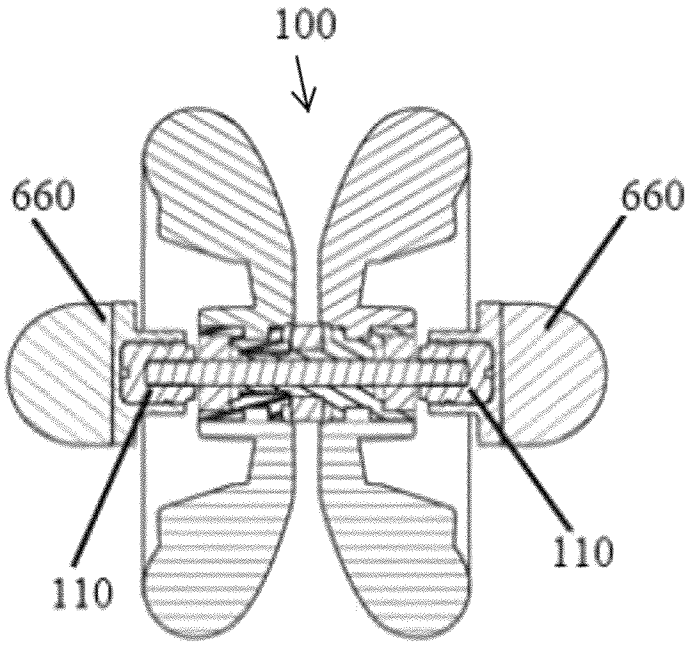
FIG. 7 is an illustration of a cross-sectional view of one embodiment of the yo-yo showing the accessories attached onto the yo-yo.

FIG. 7 is an illustration of a cross-sectional view of one embodiment of the yo-yo showing the accessories attached onto the yo-yo. As shown in FIG. 7, the stunt accessories 660 are preferably removably attached to outside end caps 110 and held in place by friction. The stunt accessories 660 is one of a plurality of stunt accessories. Stunt accessories 660 are preferably made of plastic and provide a way for the user to perform various stunts, such as grasping the yo-yo while it is spinning, bouncing the stunt accessories 660 off various objects, vertical and horizontal. Because the yo-yo is preferably spinning when these tricks are being performed, the gyro stability allows the yo-yo to balance on its side without tipping over.

Figure 8:
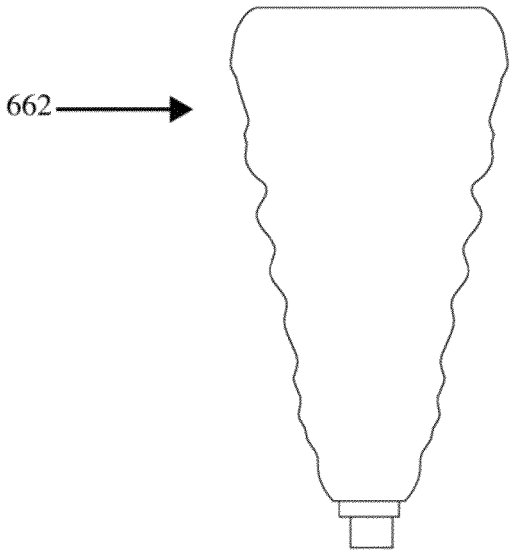
FIG. 8 is an illustration of one embodiment of a cone stunt accessory.

FIG. 8 is an illustration of one embodiment of a cone stunt accessory. One stunt accessory comprises two substantially conic shaped attachments 663 approximately one inch in length. These may be longer or shorter. One or more may be used, depending on the yo-yo user's desired engageability. In one embodiment a single substantially conic attachment is used on one side of the accessory attachment system while a top end is placed on the opposite accessory attachment system. This permits the yo-yo to function as a top when the string is not attached.

Figure 9:
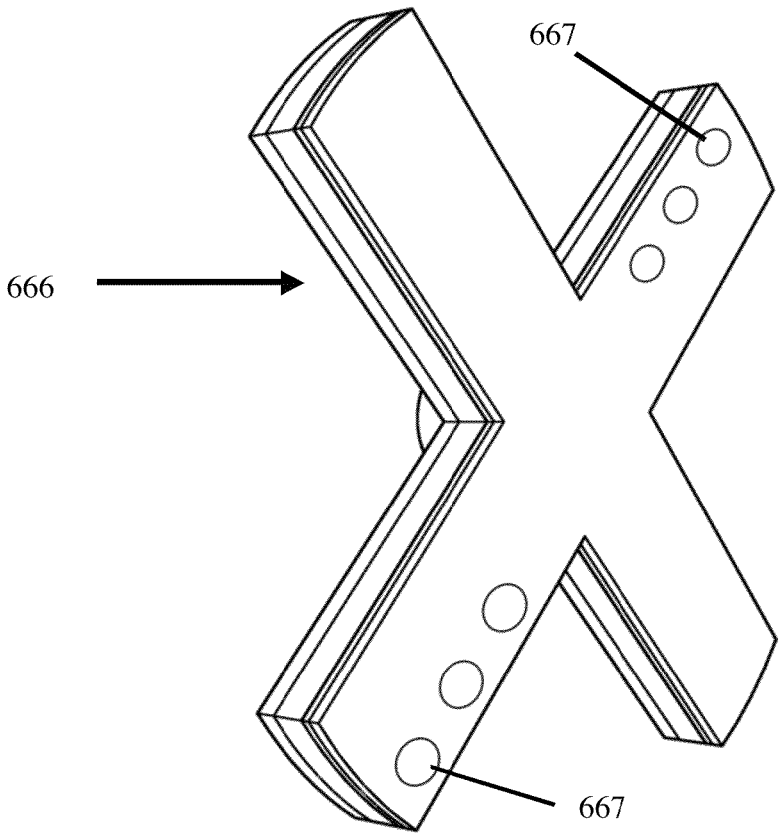
FIG. 9 is an illustration of one embodiment of a lit stunt accessory.

FIG. 9 is an illustration of one embodiment of a lit stunt accessory. One lit stunt accessory 666 comprises a single piece containing two crossed-lighted bars 667 that automatically turn on when subjected to a jarring motion, like when a yo-yo is tossed toward the ground. As this is intended to be viewed from the side, either a single lighted piece or two lighted pieces may be used, depending on whether there will be observes on one or both sides of the yo-yo. When the lighted bars rotate with the yo-yo, the lights form a trace pattern of concentric circles.

Figure 10:
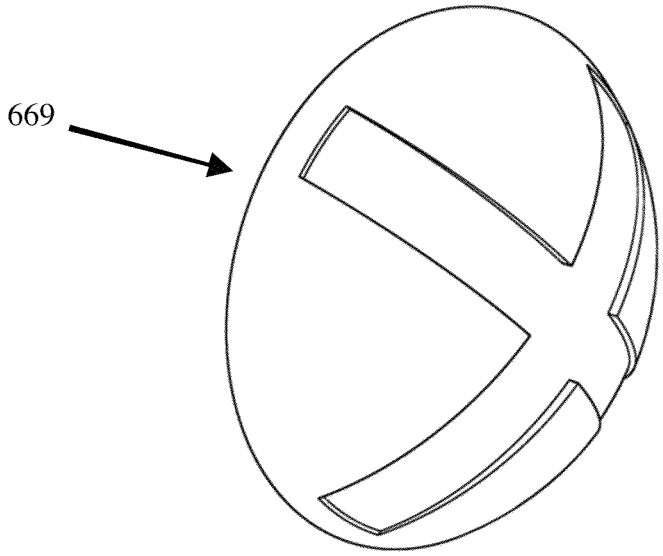
FIG. 10 is an illustration of one embodiment of a large hemisphere stunt accessory.

FIG. 10 is an illustration of one embodiment of a large hemisphere stunt accessory. One large hemisphere stunt accessory 669 comprises two hemispherical bounce ready accessories. These can be imagined as "half balls," though there exact degree measurement need not be half of a ball. These half balls permit the yo-yo to be bounced off of a variety of surfaces, while still maintaining its main rotational momentum. These are preferentially made with rubber to maximize the bounciness of the half ball structure.

Figure 11:
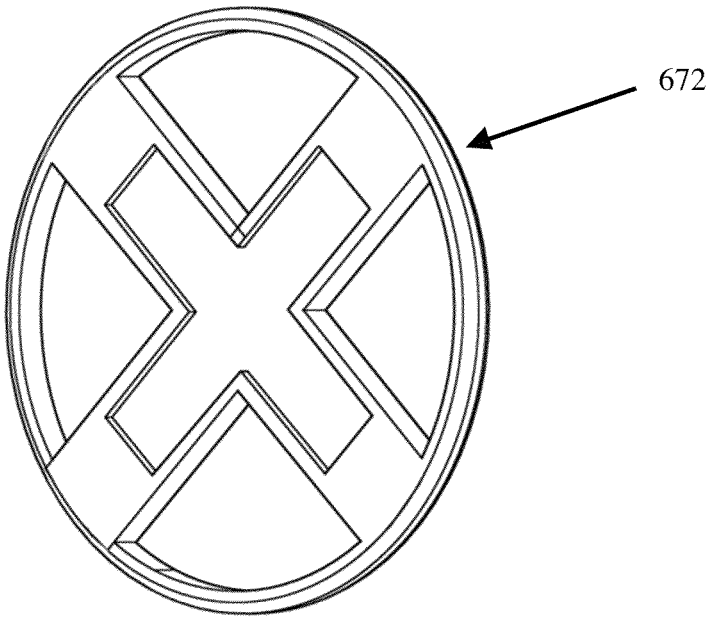
FIG. 11 is an illustration of one embodiment of wheel stunt accessory.

FIG. 11 is an illustration of one embodiment of wheel stunt accessory. One wheel stunt accessory 672 comprises two oversized wheel shaped accessories. The important feature of this accessory is that the diameter of the rotating disks is smaller than the diameter of the wheel stunt accessory 672. This permits the yo-yo to rest on the ground or any other flat surface on the wheels, without disrupting the rotation of the main yo-yo. The size of the oversized wheels also allows the user to engage the accessory system without upsetting the spin of the rotational disks of the main yo-yo.

Figure 12:
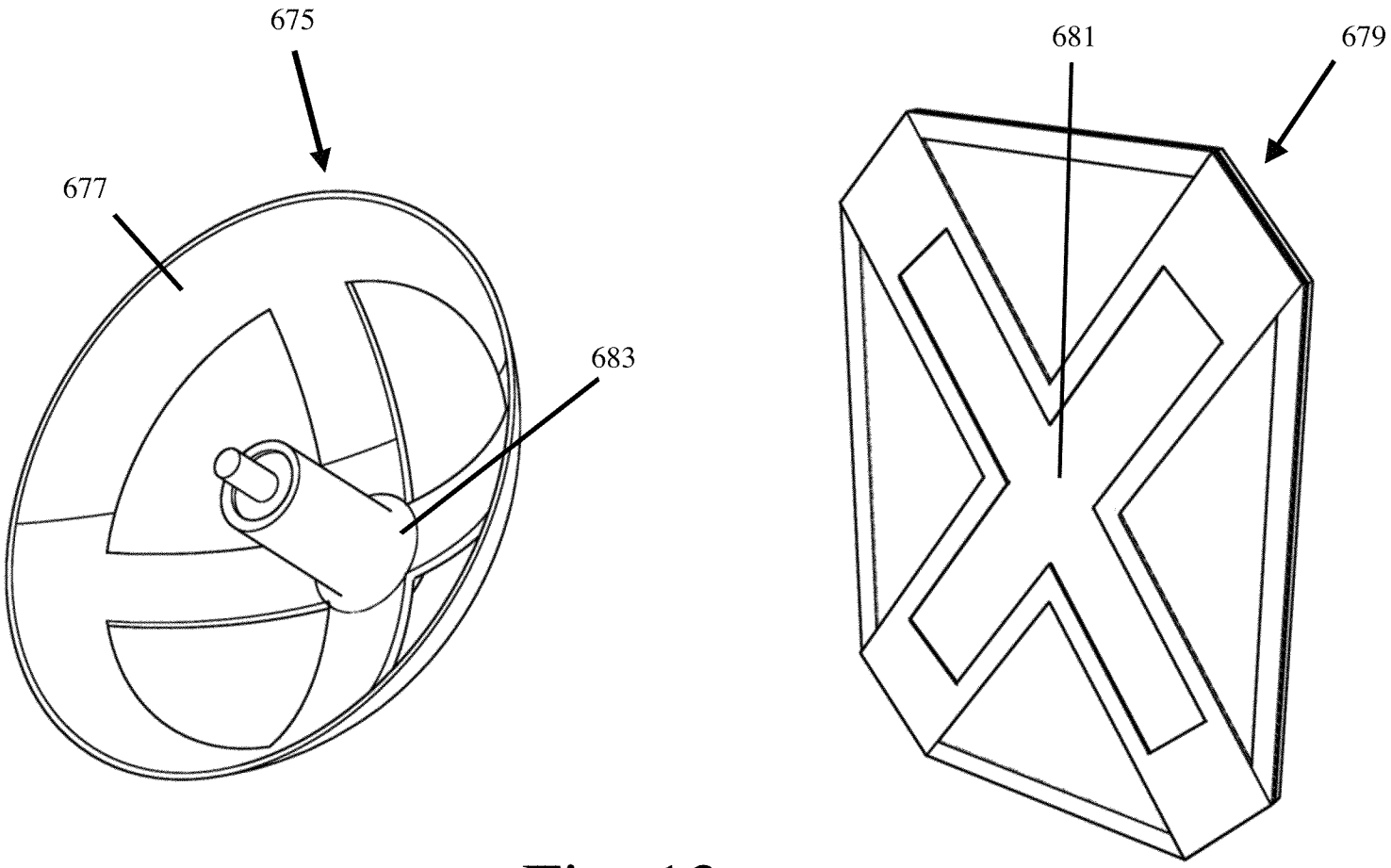
FIG. 12 is an illustration of one embodiment of a magnet stunt accessory.

FIG. 12 is an illustration of one embodiment of a magnet stunt accessory. One magnet stunt accessory 675 comprises a magnet 683 encased in a hemispherical housing 677 as well as a corresponding card 679 with a magnet 681 in the center. When attached to the accessory attachment system, the magnet hemisphere can be used to pick up the corresponding card as part of a game or a yo-yo performance. The hemisphere is preferentially made of plastic, but can alternatively be made of rubber or any other material that would be apparent in the art. The card is preferentially made from cardboard, but can be made from any material that would be apparent in the art.

The above stunt accessories are merely illustrative and not intended to limit the sorts of accessories that might provide unique functionalities by attaching to the accessory attachment system.

Figure 13:
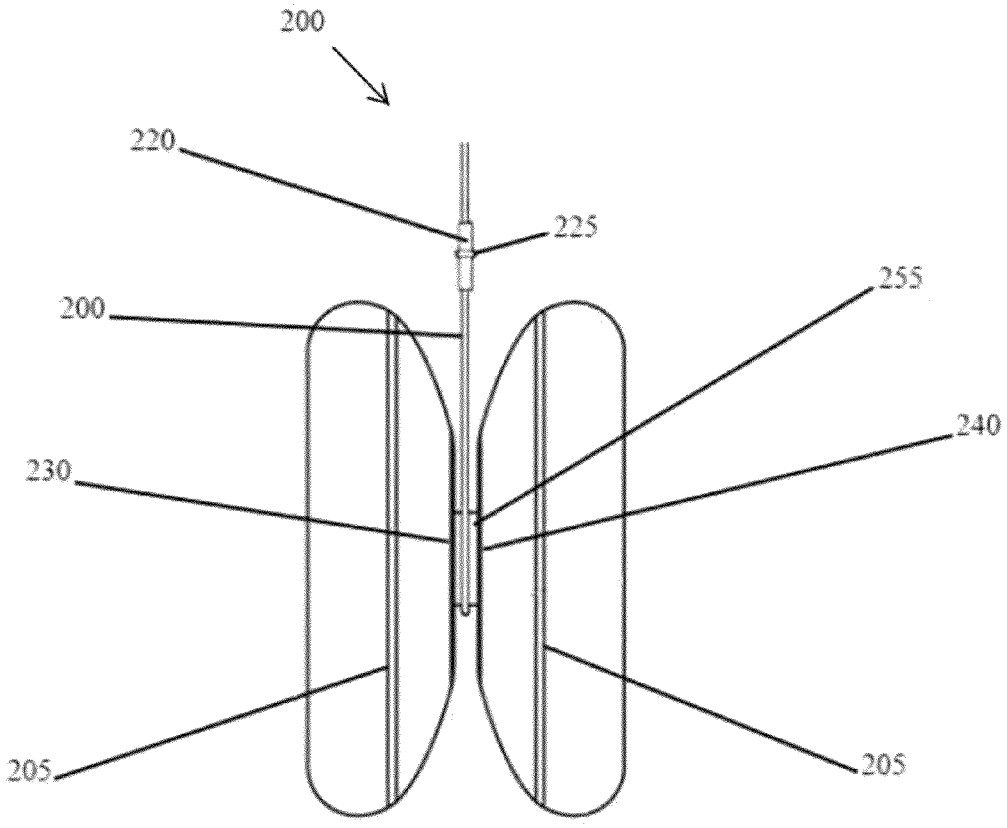
FIG. 13 is an illustration of one embodiment of a yo-yo with a bead.

FIG. 13 is an illustration of one embodiment of a yo-yo with bead. FIG. 13 shows that in one embodiment of the yo-yo 200 the string 200 may have a bead 220. The string 200 preferably loops around center bearing 255, as is well known in the art. As shown in FIG. 13, the bead 220 surrounds a portion of the string 200 and is slidably movable along the length of the string 200. This slidability permits the user to change the bead's 220 proximity to the center bushing 255. This, in turn, allows the user to control the recoil of the yo-yo 200. Bead 220 preferably has bulge 225, which engages with the interior sides 230 and 240 of the rotating disks 105 to cause the yo-yo to recoil up string 200. When the bead 220 engages with interior sides 230 and 240, this causes a "sleeping" yo-yo too readily and more easily recoil than without the bead 220.

In one embodiment of the invention, the string 200 is not permanently looped around center bearing 155, but is loose and removably attached to the yo-yo 200 through bead 220. This allows the user to control completely when the yo-yo 200 recoils with string 200, which is only when the user drags or places the bead 220 between the rotating disks 205 so that the bead 220 catches and the yo-yo recoils.

In one embodiment, the two rotating disks can be tightened to the right, with respect to each other, so that the axle is freely moving. When the main body disks are loosened to the left and/or tightened to the left, the axle is secured in a locked position and is no longer freely moving. This locking permits a user greater control of the functionality of the yo-yo.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A yo-yo comprising:
a plurality of rotating disks;
one or more bearing portions;
a string; an axle;
one or more end caps; and
one or more stunt accessories;
wherein said one or more end caps are attached to said axle;
wherein said one or more end caps and said axle are connected to said plurality of rotating disks through said one or more bearing portions, such that said plurality of rotating disks are rotatable with respect to said axle and said one or more end caps;
wherein said one or more stunt accessories are detachably connected to said one or more end caps;
wherein said one or more stunt accessories and said one or more end caps are engagable to a user, such that said yo-yo may be held by said one or more stunt accessories and said one or more end caps without interrupting a spin of said plurality of rotating disks.

2. The yo-yo of claim 1, further comprising:
a plurality of bearing housings;
wherein said one or more bearing portions is comprised of a center bearing and a plurality of side bearings;
wherein said plurality of side bearings are enclosed within said plurality of bearing housings.

3. The yo-yo of claim 2, wherein said axle passes through and is held in place by said one or more bearing portions;
wherein said center bearing matingly surrounds at least one of said plurality of bearing housings;
wherein there are two rotating disks;
wherein said center bearing separates said two rotating disks;
wherein said string engages with said center bearing.

4. The yo-yo of claim 3, wherein said one or more stunt accessories are selected from the group of stunt accessories consisting of: a lit stunt accessory; a large hemispherical stunt accessory; a wheel stunt accessory; a magnet stunt accessory, and a small hemispherical stunt accessory.

5. The yo-yo of claim 4, wherein said center bearing has an outer surface that rotates independently from said plurality of plurality of accessories are rotationally independent from said plurality of rotating disks.

6. A yo-yo comprising:
a plurality of rotating disks;
one or more bearing portions;
a string;
a bead;
an axle;
one or more end caps; and
one or more stunt accessories;
wherein said one or more end caps are attached to said axle;
wherein said one or more end caps and said axle are connected to said plurality of rotating disks through said one or more bearing portions, such that said plurality of rotating disks are rotatable with respect to said axle and said one or more end caps;
wherein said one or more stunt accessories are detachably connected to said one or more end caps;
wherein said one or more stunt accessories and said one or more end caps are engagable to a user, such that said yo-yo may be held by said one or more stunt accessories and said one or more end caps without interrupting a spin of said plurality of rotating disks.

7. The yo-yo of claim 6, wherein said bead is slidably movable along a length of the string.

8. The yo-yo of claim 7, wherein said bead engages with an interior surface of said plurality of rotating disks, such that said yo-yo recoils up said string.

9. The yo-yo of claim 8, further comprising:
a plurality of bearing housings;
wherein said one or more bearing portions is comprised of a center bearing and a plurality of side bearings;
wherein said plurality of side bearings are enclosed within said plurality of bearing housings.

10. The yo-yo of claim 9, wherein said axle passes through and is held in place by said one or more bearing portions;
wherein said center bearing matingly surrounds at least one of said plurality of bearing housings;
wherein there are two rotating disks;
wherein said center bearing separates said two rotating disks;
wherein said string engages with said center bearing.

11. The yo-yo of claim 10, wherein said bead is comprised of a bulge;
wherein said bulge engages with said interior surface of said plurality of rotating disks.

12. The yo-yo of claim 11, wherein said one or more stunt accessories are selected from the group of stunt accessories consisting of: a lit stunt accessory; a large hemispherical stunt accessory; a wheel stunt accessory; a magnet stunt accessory, and a small hemispherical stunt accessory.

13. The yo-yo of claim 12, wherein said center bearing has an outer surface that rotates independently from said plurality of plurality of accessories are rotationally independent from said plurality of rotating disks.

14. A yo-yo comprising:
a plurality of rotating disks;
one or more bearing portions;
a string;
a bead;
an axle;
wherein said axle is connected to said plurality of rotating disks through said one or more bearing portions, such that said plurality of rotating disks are rotatable with respect to said axle;
wherein said bead is slidably movable along a length of the string.

15. The yo-yo of claim 14, wherein said bead engages with an interior surface of said plurality of rotating disks, such that said yo-yo recoils up said string.

16. The yo-yo of claim 15, wherein said bead is comprised of a bulge;

wherein said bulge engages with said interior surface of said plurality of rotating disks.

17. The yo-yo of claim 16, further comprising:

a plurality of bearing housings;

wherein said one or more bearing portions is comprised of a center bearing and a plurality of side bearings;

wherein said plurality of side bearings are enclosed within said plurality of bearing housings.

18. The yo-yo of claim 17, wherein said axle passes through and is held in place by said one or more bearing portions;

wherein said center bearing matingly surrounds at least one of said plurality of bearing housings;

wherein there are two rotating disks;

wherein said center bearing separates said two rotating disks;

wherein said string engages with said center bearing.

19. The yo-yo of claim 18, wherein said center bearing has an outer surface that rotates independently from said plurality of rotating disks.

* * * * *